United States Patent [19]

Tabei

[11] Patent Number: 4,750,953

[45] Date of Patent: Jun. 14, 1988

[54] COPPER-BASE SHAPE-MEMORY ALLOYS

[75] Inventor: Kazuhiko Tabei, Urawa, Japan

[73] Assignee: Mitsubishi Kinzoku Kabushiki Kaisha, Tokyo, Japan

[21] Appl. No.: 861,734

[22] Filed: May 7, 1986

Related U.S. Application Data

[63] Continuation-in-part of Ser. No. 772,336, filed as PCT JP84/00612, Dec. 24, 1984, published as WO 85/02865, Jul. 4, 1985, abandoned.

[30] Foreign Application Priority Data

Dec. 26, 1983 [JP] Japan ..... 58-244094

[51] Int. Cl.[4] ..... C22C 9/04

[52] U.S. Cl. ..... 148/402; 420/479

[58] Field of Search ..... 420/478, 479; 148/402, 148/413, 434

[56] References Cited

U.S. PATENT DOCUMENTS

| | | | |
|---|---|---|---|
| 4,242,132 | 12/1980 | Shapiro et al. | 420/480 |
| 4,249,942 | 2/1981 | Shapiro et al. | 420/480 |
| 4,472,213 | 9/1984 | Tabei et al. | 420/478 |

FOREIGN PATENT DOCUMENTS

| | | | |
|---|---|---|---|
| 0906786 | 8/1972 | Canada | 420/478 |
| 0029642 | 3/1981 | Japan | 420/480 |
| 0006952 | 1/1983 | Japan | 420/479 |
| 0181841 | 10/1983 | Japan | 148/402 |
| 0003835 | 1/1984 | Japan | 148/402 |
| 0059035 | 4/1985 | Japan | 148/402 |
| 0077948 | 5/1985 | Japan | 148/402 |

*Primary Examiner*—L. Dewayne Rutledge
*Assistant Examiner*—S. Kastler
*Attorney, Agent, or Firm*—Frishauf, Holtz, Goodman & Woodward

[57] ABSTRACT

A copper-base shape-memory alloy consisting essentially of 15–35% Zn, 3.2–10% Al, 0.01–1% Si, at least one element selected from the group of 0.5–2% Ti, 0.01–1% Cr, 0.01–8% Mn, 0.01–2% Co and 2.1–4% Ni, the balance being Cu and incidental impurities, the percent being by weight is disclosed.

This alloy has high resistance to intercrystalline cracking and thermal cycling as well as improved shape-memory properties.

3 Claims, 1 Drawing Sheet

COPPER-BASE SHAPE-MEMORY ALLOYS

This application is a continuation-in-part of application Ser. No. 772,336, filed as PCT JP84/00612, Dec. 24, 1984, published as WO85/02865, Jul. 4, 1985, now abandoned.

FIELD OF THE ART

The present invention relates to copper-base shape-memory alloys having improved shape-memory properties, in particular, high resistance to intercrystalline cracking and thermal cycling.

BACKGROUND OF THE ART

The shape-memory effect of shape-memory alloys occurs due to the transition from the beta-phase at high temperatures to the thermoelastic martensite phase at low temperatures. The effect is either irreversible or reversible. Applications which use the irreversible shape-memory effect are found in connectors and couplings, and those which utilize the reversible effect are in window openers, heat-actuated water sprinklers and heat-actuated safety switches, as well as thermo-driven apparatus such as heat engines.

Furthermore, shape-memory alloys can be used in spectacles frames or vacuum seal packings since they have super-elastic effects and will, even placed under a strain of several to ten-odd percent, return to the original shape upon removal of the stress. Shape-memory alloys also have vibration-proofing effects and find use in the manufacture of gears and other various machine parts that require vibration- and sound-proofing.

Many shape-memory alloys have been proposed and some of them are currently used on a commercial basis. One of the commercial shape-memory alloys is based on copper and contains 10–35% Zn and 1–12% Al, with the balance being Cu and incidental impurities (the percent being on a weight basis and will be so hereunder). This alloy has excellent shape-memory effects and is getting particular attention of researchers.

Despite its excellent shape-memory properties, the above described Cu-Zn-Al alloy has two serious problems: firstly, it undergoes intercrystalline cracking under relatively small internal stresses caused either by restraining the displacement that will otherwise occur or by application of a load; secondly, the alloy has a reduced resistance to heat cycles in that the behavior of reversible transformation between the martensite and beta-phases changes to such an extent that the amount of potential shape restoration is decreased.

DISCLOSURE OF THE INVENTION

We therefore made various studies in order to provide the conventional Cu-Zn-Al shape-memory alloys with high resistance to intercrystalline cracking and thermal cycling without spoiling its inherently good shape memory properties. As a result, we have found that this object can be attained by an alloy composition containing:

15–35% Zn,
3.2–10% Al,
0.01–1% Si, and
at least one of 0.5–2% Ti, 0.01–1% Cr, 0.01–8% Mn, 0.01–2% Co and 2.1–4% Ni, the balance being Cu and incidental impurities.

This alloy has such a structure that the fine grains of an intermetallic compound based on Si and at least one element of Ti, Cr, Mn, Co and Ni are uniformly dispersed in the matrix. The fine grains of this intermetallic compound are highly heat stable and will remain intact in the matrix even if the alloy is subjected to hot- or cold-working or other heat treatments after casting. Because of the presence of this intermetallic compound, the alloy possesses significantly improved resistance to intercrystalline cracking and heat cycling while maintaining the inherent good shape-memory properties. In addition, Zn and Al present as alloying elements will ensure the excellent shape-memory properties of the alloy.

The present invention was accomplished on the basis of the above-mentioned findings. The criticality of the amount of each component of the alloy according to the present invention is stated as follows.

(a) Zn and Al

These elements are necessary for obtaining the shape-memory effect. This effect is not achieved if the Zn content is less than 15% and the Al content is less than 3.2%. Aluminum is also effective in controlling the deformation of the martensite phase and preventing the loss of zinc at elevated temperatures. This is another reason why aluminum must be present in an amount of 3.2% or more. If more than 35% of zinc and more than 10% of aluminum are contained in the alloy, it becomes brittle. Therefore, the contents of zinc and Al are specified in the amounts of 15–35% and 3.2–10%, respectively.

(b) Si, and one of Ti, Cr, Mn, Co and Ni

As mentioned above, Si combines with one or more of Ti, Cr, Mn, Co and Ni to form an intermetallic compound based on these elements. In the alloy of this invention, the fine grains of such intermetallic compound are uniformly dispersed in the matrix, thereby providing excellent resistance to both intercrystalline cracking and heat cycling. If the amount of Ti, Cr, Mn, Co and Ni are less than 0.5%, 0.01%, 0.01%, 0.01% and 2.1% respectively, the intended intermetallic compound is crystallized insufficiently to provide the desired improvement in the resistance to intercrystalline cracking and heat cycling. On the other hand, if $Si>1\%$, $Ti>2\%$, $Cr>1\%$, $Mn>8\%$, $Co>2\%$ and $Ni>4\%$, excessive crystallization of the intermetallic compound causes a decrease in the ductility of the alloy. Therefore, in order to achieve the object of the invention, the amounts of the respective elements are limited to the following ranges: $0.01\% \leqq Si \leqq 1\%$, $0.5\% \leqq Ti \leqq 2\%$, $0.01\% \leqq Cr \leqq 1\%$, $0.01\% \leqq Mn \leqq 8\%$, $0.01\% \leqq Co \leqq 2\%$ and $2.1\% \leqq Ni \leqq 4\%$.

BEST MODE OF CARRYING OUT THE INVENTION

Figure 1:
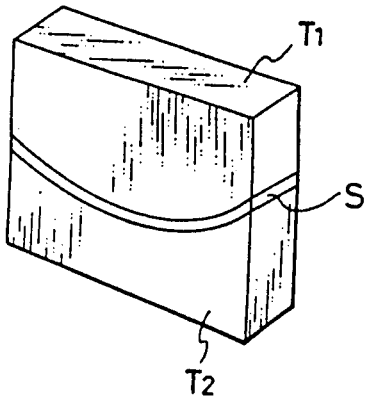
FIG. 1 is a perspective view showing an alloy sample set in a deformation restrainer used in an intercrystalline cracking test.

The advantages of the Cu-based shape-memory alloy of the present invention are hereunder described by reference to a working example.

Twenty-two Cu alloy samples of the present invention and two conventional samples having the compositions indicated in Table 1 were prepared by melting in a high-frequency induction heating furnace. Each alloy was cast to an ingot which was subjected to routine hot and cold working so as to form two shapes, one being a sheet with a thickness of 1 mm and the other being a wire with a diameter of 3 mm. The sheet was subjected to an intercrystalline cracking test and the wire was subjected to a heat cycle test.

The intercrystalline cracking test was conducted in the following manner. Test pieces 5 mm wide which were cut from each of the sheet samples were held at predetermined temperatures between 580° and 850° C. for 1 hour and subsequently cooled with water to transform the test piece to the beta-phase; then, the so transformed test piece was set in three types of deformation restrainers having the appearance shown in FIG. 1 and consisting of two elements T1 (radius of curvature, R: 50 mm, 25 mm and 16 mm) and T2. As shown in FIG. 1, the test piece S with the martensite structure was deformed as it was sandwiched between T1 and T2, and within this restrainer, the test piece was subjected to a heat cycle consisting of heating to the temperature, $T_{Ms}$ (temperature at which martensite transformation started) plus 40° C., so as to develop internal stress, followed by cooling to the temperature, $T_{Ms}$ minus 20° C. After repeating this cycle 10 times, the test piece was observed under a stereoscopic microscope to examine if any intercrystalline crack had occurred. The results are shown in Table 1, wherein O indicates the absence of intercrystalline cracking and X, the presence of such cracking.

The heat cycle test was conducted by the following procedure. The wire was hot-worked at 550° C. into coil springs (average coil diameter: 15 mm, number of turns: 8, pitch: 5.5 mm), which were held at predetermined temperatures between 580° and 850° C. for one hour and subsequently cooled with water to transform each of the springs into the beta-phase. Each of the transformed springs was subjected to reversible memory processing by the training method. Thereafter, each spring was subjected to a heat cycle consisting of heating, under no load, to the temperature, $T_{Af}$(temperature at which beta-transformation ended) plus 20° C., followed by cooling to the temperature, $T_{Mf}$(temperature at which martensite transformation ended) minus 20° C. This heat cycle was repeated 5,000 times. The resistance of each sample to heat cycling was evaluated in terms of the total amount of displacement in the spring after testing, relative to the total amount of displacement in the virgin spring taken as 100%. The results of the heat cycle test are also shown in Table 1.

TABLE 1

| Alloy Sample No. | Composition (wt %) Zn | Al | Si | Ti | Cr | Mn | Co | Ni | Cu | Resistance to intercrystalline cracking Radious of curvature of T1 50 mm | 25 mm | 16 mm | Resistance to thermal cycling Ratio of the total amount of displacement after testing to the total amount of displacement before testing (%) |
|---|---|---|---|---|---|---|---|---|---|---|---|---|---|
| Copper alloys of the present invention | | | | | | | | | | | | | |
| 1 | 30.1 | 3.6 | 0.30 | 0.61 | — | — | — | — | bal. | O | O | O | 90 |
| 2 | 25.5 | 4.2 | 0.41 | 0.77 | — | — | — | — | bal. | O | O | O | 91 |
| 3 | 20.6 | 6.0 | 0.33 | 0.69 | — | — | — | — | bal. | O | O | O | 90 |
| 4 | 15.3 | 8.3 | 0.52 | 1.01 | — | — | — | — | bal. | O | O | O | 93 |
| 5 | 20.5 | 6.0 | 0.92 | 1.81 | — | — | — | — | bal. | O | O | O | 92 |
| 6 | 20.4 | 5.9 | 0.04 | — | 0.02 | — | — | — | bal. | O | O | X | 89 |
| 7 | 20.2 | 5.7 | 0.80 | — | 0.81 | — | — | — | bal. | O | O | O | 92 |
| 8 | 20.6 | 5.9 | 0.03 | — | — | 0.04 | — | — | bal. | O | X | X | 90 |
| 9 | 19.5 | 5.2 | 0.55 | — | — | 2.15 | — | — | bal. | O | O | O | 92 |
| 10 | 18.8 | 3.5 | 0.98 | — | — | 7.80 | — | — | bal. | O | O | O | 90 |
| 11 | 20.4 | 6.0 | 0.04 | — | — | — | 0.03 | — | bal. | O | O | X | 90 |
| 12 | 20.2 | 6.1 | 0.08 | — | — | — | 1.90 | — | bal. | O | O | O | 94 |
| 13 | 20.4 | 6.0 | 0.91 | — | — | — | — | 3.82 | bal. | O | O | O | 94 |
| 14 | 20.4 | 5.9 | 0.92 | — | 0.04 | — | — | 2.31 | bal. | O | O | O | 90 |
| 15 | 20.2 | 5.9 | 0.48 | 0.64 | 0.29 | — | 1.10 | — | bal. | O | O | O | 88 |
| Conventional Cu alloys | | | | | | | | | | | | | |
| 1 | 20.6 | 6.1 | — | — | — | — | — | — | bal. | X | X | X | 77 |
| 2 | 26.0 | 4.3 | — | — | — | — | — | — | bal. | X | X | X | 75 |

The results in Table 1 show that Cu alloy sample Nos. 1 to 22 of the present invention had higher resistance to intercrystalline cracking and heat cycling than conventional samples 1 and 2.

As will be apparent from the foregoing description, the Cu-based shape-memory alloy of the present invention exhibits high resistance to intercrystalline cracking and heat cycling that results from fact that the fine grains of an intermetallic compound based on Si and at least one of Ti, Cr, Mn, Co and Ni are uniformly dispersed in the matrix. In addition, Zn and Al present as alloying elements are effective in retaining the excellent shape-memory properties of the alloy.

What is claimed is:

1. A Cu-base shape-memory $\beta$-phase alloy having high resistance to intercrystalline cracking and thermal cycling, consisting essentially of 15–35% Zn, 3.2–10% Al, 0.01–1% Si and at least one element selected from the group consisting of 0.5–2% Ti, 0.01–1% Cr, 0.01–8% Mn, 0.01–2% Co and 2.1–4% Ni, the balance being Cu and incidental impurities, the percent being by weight, said $\beta$-phase alloy having been heated to between 580° and 850° C. and then cooled rapidly to form an alloy having a structure consisting essentially of a $\beta$-phase matrix with fine grains of an intermetallic compound of Si and said at least one element selected from the group consisting of Ti, Cr, Mn, Co and Ni uniformly dispersed in the matrix.

2. A Cu-base shape-memory alloy according to claim 1 wherein the Si content is from 0.01 to 0.3%.

3. A Cu-base shape-memory alloy according to claim 1 wherein the Si content is from 0.3 to 1.0%.

* * * * *

UNITED STATES PATENT AND TRADEMARK OFFICE

CERTIFICATE OF CORRECTION

PATENT NO. : 4,750,953

DATED : June 14, 1988

INVENTOR(S) : TABEI

It is certified that error appears in the above-identified patent and that said Letters Patent is hereby corrected as shown below:

On title page, item [63] replace

"[63] Continuation-in-part of Ser. No. 772,336, filed as PCT JP84/00612, Dec. 24, 1984, published as WO 85/02865, Jul. 4, 1985, abandoned."

with

--[63] Continuation-in-part of Ser. No. 772,336, filed Aug. 19, 1985 abandoned as the U.S. designated application of PCT/JP84/00612 filed Dec. 24, 1984.

Column 1, lines 4, 5, 6 and 7, replace all of the subject matter on these lines with --This application is a continuation-in-part of application Ser. No. 772,336, filed Aug. 19, 1985 abandoned, which is the U.S. designated application of PCT/JP84/00612 filed Dec. 24, 1984.--

Signed and Sealed this

Eighth Day of November, 1994

*Attest:*

Bruce Lehman

BRUCE LEHMAN

*Attesting Officer*

*Commissioner of Patents and Trademarks*